US006701550B2

(12) United States Patent
Baeriswyl

(10) Patent No.: US 6,701,550 B2
(45) Date of Patent: Mar. 9, 2004

(54) SLATTED FRAME FOR RECLINING FURNITURE

(75) Inventor: Florin Baeriswyl, Erlenbach (CH)

(73) Assignee: D. Li Florin Baeriswyl, Erlenbach (CH)

( * ) Notice: Subject to any disclaimer, the term of this patent is extended or adjusted under 35 U.S.C. 154(b) by 94 days.

(21) Appl. No.: 09/979,127

(22) PCT Filed: Apr. 3, 2001

(86) PCT No.: PCT/CH01/00215

§ 371 (c)(1),
(2), (4) Date: Nov. 20, 2001

(87) PCT Pub. No.: WO01/74199

PCT Pub. Date: Oct. 11, 2001

(65) Prior Publication Data

US 2002/0178498 A1 Dec. 5, 2002

(51) Int. Cl.[7] ..... A47C 23/06
(52) U.S. Cl. ..... 5/236.1; 5/238; 5/242
(58) Field of Search ..... 5/236.1, 238, 239, 5/241, 242

(56) References Cited

U.S. PATENT DOCUMENTS

| | | | | | |
|---|---|---|---|---|---|
| 63,066 | A | * | 3/1867 | Manuel | 5/242 |
| RE3,311 | E | * | 2/1869 | Manuel | 5/242 |
| 87,184 | A | * | 2/1869 | Mattson | 5/237 |
| 981,966 | A | * | 1/1911 | Ambrozy | 5/236.1 |
| 1,167,692 | A | * | 1/1916 | Hinton | 5/236.1 |
| 4,567,615 | A | * | 2/1986 | Fanti | 5/238 X |
| 4,752,981 | A | * | 6/1988 | Salens | 5/238 |
| 5,282,285 | A | * | 2/1994 | de Gelis et al. | 5/237 |
| 5,469,589 | A | * | 11/1995 | Steed et al. | 5/400 |
| 5,774,911 | A | * | 7/1998 | Stube et al. | 5/236.1 |
| 6,256,815 | B1 | * | 7/2001 | Degen | 5/236.1 |
| D458,767 | S | * | 6/2002 | Baeriswyl | D6/382 |
| 2001/0014984 | A1 | * | 8/2001 | Degen | 5/236.1 |
| 2002/0178498 | A1 | * | 12/2002 | Baeriswyl | 5/200.1 |

FOREIGN PATENT DOCUMENTS

| | | | | |
|---|---|---|---|---|
| DE | 2 020 456 | | 11/1970 | |
| DE | 3903440 | * | 5/1990 | 5/238 |
| DE | 3932340 A | * | 5/1990 | 5/238 |
| EP | A1 0 512 569 | | 11/1992 | |
| EP | 563497 A1 | * | 10/1993 | 5/238 |
| EP | A2 0 852 124 | | 7/1998 | |
| FR | 417232 | * | 8/1910 | 5/239 |
| NL | 8400147 | * | 11/1984 | 5/238 |

* cited by examiner

*Primary Examiner*—Robert G. Santos
(74) *Attorney, Agent, or Firm*—Birch, Stewart, Kolasch & Birch, LLP

(57) ABSTRACT

A slatted base for furniture for lying on has two longitudinally running, essentially parallel longitudinal supports (50) with mutually facing inner sides (32). The slatted base also has a plurality of spaced-apart slats (10, 71, 72) which are arranged transversely to the longitudinal supports (50) and together form a bearing surface for a mattress. The slats (10, 71, 72) are connected to the longitudinal supports (50) by means of [sic] essentially two-legged leaf-spring elements (20, 81, 82), in each case one leg (22) of a leaf-spring element (20) being fitted on one of the slats (10) and the other leg (23) of said leaf-spring element (20) being fitted on the inner side (32) of one of the longitudinal supports (50). The slatted base, on the one hand, is of low overall height and is thus suitable for positioning in a framework of a piece of furniture for lying on. The slatted base, on the other hand, ensures a comparatively high level of resilient deflection for the slats (10, 71, 72), in particular also in the region of the longitudinal supports (50) bearing the slats (10, 71, 72).

50 Claims, 5 Drawing Sheets

SLATTED FRAME FOR RECLINING FURNITURE

This application is the national phase under 35 U.S.C. § 371 of PCT International Application No. PCT/CH01/00215 which has an International filing date of Apr. 3, 2001, which designated the United States of America.

1. Technical Field

The present invention relates to a slatted base for furniture for lying on according to the preamble of the independent patent claim, it being possible for the slatted base to be positioned, in particular, in the framework of a piece of furniture for lying on.

2. Prior Art

BICO Birchler & Co. AG's European Patent Application EP-A1-0 761 138 describes a slatted base for furniture for lying on. Since the resilient-slat-bearing longitudinal supports, which are designed as outer longitudinal spars of a slatted-base frame, are inclined inward, space is provided for fitting supporting bodies for the resilient slats on the outer side of the longitudinal supports. These supporting bodies are produced from hard plastic and elastomeric material. Since, on the one hand, the entire overall height of a slatted base which can be positioned in a bedstead is limited by the dimensions of the bedstead and, on the other hand, the supporting bodies of the slatted base according to EP-A1-0 761 138 are arranged at least partially over the longitudinal supports, the level of resilient deflection which is available for the slats in the region of the longitudinal supports is relatively low.

DESCRIPTION OF THE INVENTION

The object of the present invention is to specify a slatted base which, on the one hand, is of a low overall height and, on the other hand, ensures a high level of resilient deflection for the slats, in particular also in the region of the longitudinal supports bearing the slats.

The object is achieved by the features of claim 1. According to the invention, a slatted base for furniture for lying on has two longitudinally running, essentially parallel longitudinal supports with mutually facing inner sides. The terms "inner" and "outer" should always be understood, in the present context, in respect of the slatted base. The slatted base also has a plurality of slats which are spaced apart transversely to the longitudinal supports and together form a bearing surface for a mattress. The slats are connected to the longitudinal supports by means of [sic] essentially two-legged leaf-spring elements, in each case one leg of a leaf-spring element being fitted on one of the slats and the other leg of said leaf-spring element being fitted on the inner side of one of the longitudinal supports.

A two-legged leaf-spring element should be understood, in conjunction with the present description and the patent claims, as a spring element which has two legs in the manner of leaf springs which has a leaf-like or strip-like, essentially flat structure.

Since, according to the invention, the slats are connected to the longitudinal supports, or are borne thereon, by means of flat, leaf-spring-like elements which are fitted on the side surface of the longitudinal supports, the connecting elements require just a small amount of space in the spring-movement direction, i.e. essentially transverse to the longitudinal direction of the supports and to the longitudinal direction of the slats. The space required in the spring-movement direction by said flat leaf-spring elements in the region of the longitudinal supports corresponds essentially to the thickness of the spring legs fitted on the slats. This small amount of space which is required is advantageous, in particular, in slatted-base structures in which the spring legs fitted on the slats are arranged partially between the slats and the longitudinal supports and, by virtue of the slatted base being subjected to loading, are pressed down onto said longitudinal supports.

According to a preferred manner of implementing the invention, in the case of a slatted base, at least one of the leaf-spring elements is arranged such that its spring leg which is fitted on the longitudinal support extends, from the region in which it is fitted on the longitudinal support, in a direction which, in relation to the plane defined by the two longitudinal supports, is inclined toward the slat which is connected to the leaf-spring element. It is preferable for even all of the leaf-spring elements to be arranged in this way.

The slatted base, or the slatted-base plane defined by the two longitudinal supports, is usually arranged essentially horizontally. In this case, the spring leg extends, in the region of the longitudinal support, obliquely upward from the longitudinal support. As a result, in the case of a horizontal arrangement of the slatted base, the force to which the two longitudinal supports are subjected by the spring elements, which are subjected to loading essentially vertically from above by the slats, is introduced obliquely downward rather than, as is conventional, either in the horizontal direction or in the vertical direction. This geometrical arrangement of the slats, of the leaf-spring elements and of the longitudinal supports relative to one another is particularly well adapted to the present situation. The angle of inclination between the spring legs and the (usually horizontal) plane defined by the two longitudinal supports in the region in which the spring legs are fitted on the longitudinal supports is preferably between 5 and 80 degrees, angles of inclination between 20 and 45 degrees, in particular angles of inclination of approximately 30 degrees, being particularly preferred.

A leaf-spring element of a slatted base according to the invention preferably has an essentially U-shaped configuration with two leg sections and a web section connecting these two leg sections. In this case, the spring element is preferably fitted on the slatted base such that the web section is arranged in the interior of the slatted base (i.e. between the two longitudinal supports), with the result that the two leg sections extend outward, from the web section, toward the locations at which they are respectively fitted on the slat and on the inner side of the longitudinal support.

The leaf-spring elements of a slatted base according to the invention may be produced from glass-fiber-reinforced plastic, it being possible for the glass fibers to be arranged such that they run at least partially in a unidirectional manner, preferably ever wholly in a unidirectional manner, in the longitudinal direction of the leaf-spring elements. Leaf-spring elements made of glass-fiber-reinforced plastic are distinguished by a particularly long service life. They are not subject to fatigue even after years of constant use. As an alternative to leaf-spring elements made of glass-fiber-reinforced plastic, it is also possible for the spring elements to be produced from spring sheet steel or from other materials which are suitable for leaf springs.

The inner side of a longitudinal support of a slatted base according to the invention is preferably provided with spring-securing means which are designed such that one or more of the leaf-spring elements can be fitted therein. The spring-securing means may be designed as integral constituent parts of the longitudinal support, or they may be fitted as separate parts on the inner side of the longitudinal support.

They may be produced from plastic, from spring sheet steel, from aluminum or from other suitable materials.

According to a preferred manner of implementing the invention, the spring-securing means comprise a hollow profile, preferably an extruded aluminum profile, which is arranged on the inner side of one longitudinal support, a groove being formed in the profile wall of the latter which is directed toward the other longitudinal support, and the groove being suitable for accommodating those leg ends of the leaf-spring elements which are to be fitted on said spring-securing means. It is possible here for the profile wall of the hollow profile which is directed toward the other longitudinal support to be essentially planar and, in relation to the (usually horizontal) plane defined by the two longitudinal supports, to enclose an angle which is 10–85 degrees, preferably 45–70 degrees, in particular approximately 60 degrees, the groove in the wall on the inner side of the profile preferably being formed at right angles to the surface of said inner profile wall. In the case of an angle of approximately 60 degrees, a spring leg accommodated in the groove then extends at an angle of approximately 30 degrees, in relation to the horizontal, away from the hollow profile and/or from the longitudinal support on which it is fitted.

The slatted base is preferably further provided with a hollow profile which is arranged at the head end and/or at the foot end of the slatted base, transversely to the longitudinal supports, has the same cross section as the hollow profile which is arranged on the longitudinal support and is provided with a groove which is suitable for accommodating a handle. This handle, for example for drawing an adjustable slatted-base section upward, may be provided at the head end of the slatted base.

According to a further preferred manner of implementing the invention, at least two adjacent slats of the slatted base are connected to one another by connecting means in order to provide a coupling between adjacent slats which is advantageous for furniture for lying on Such a slatted base may further be provided with a mattress holder, which can be fitted on the connecting means.

According to a preferred manner of implementing the invention, a longitudinal support of a slatted base comprises a spar made of laminated wood, the entire longitudinal support and, in particular, the spar being dimensioned such that the support height over the entire length is less than approximately 50 mm, preferably less than approximately 45 mm, in particular even less than approximately 40 mm. A spar made of wood gives a warm homely impression which is particularly preferred for furniture for lying on. Nevertheless, on account of the low overall height, it is well-suited for a slatted base which is provided for positioning in a furniture framework. For the purpose of stiffening the spar structurally, said spar may be provided with one or more reinforcing strips which is/are fitted on its top side and/or on its underside and has/have carbon fibers running in the longitudinal direction of the spar. This makes it possible to produce stiff wooden spars of a particularly low overall height. This aspect of the invention also proves to be advantageous without the use of essentially two-legged leaf-spring elements for connecting the slats to the longitudinal supports if it is desired to produce a slatted base of as low an installation height as possible.

However, other variants of longitudinal supports are also possible. It is thus possible, for example, to provide, for the support, a single hollow profile which is designed such that it is simultaneously provided with suitable locations at which the leaf-spring elements are fitted. Alternatively, the support may have a laminated-wood spar which is of low overall height and does not have any reinforcing strips made of carbon fibers or other suitable fibers, a hollow profile nevertheless being arranged on the inner side of the spar such that, on the one hand, it helps to stiffen and reinforce the support structure formed from the spar and the hollow profile and, on the other hand, it serves for accommodating the leaf-spring elements which are to be fitted on the support.

A longitudinal support of a slatted base according to the invention, comprising a spar made of laminated wood, preferably has a first section, in which the spar is fixed, essentially over the entire length, to a first single-piece hollow profile which is fitted on the inner side of the spar and is designed as a spring-securing means. The longitudinal support comprises a second section, in which a second single-piece hollow profile, which again is designed as a spring-securing means, is arranged on the inner side of the spar. The second hollow profile is articulated on the first hollow profile such that it can be pivoted about a transverse axis located essentially in the plane defined by the two longitudinal supports. The second longitudinal support of the slatted base is designed analogously, with the result that the slats which are connected to the second hollow profile form a slatted-base section which can be adjusted in relation to the slats which are connected to the first hollow profile. The slatted-base section which can be adjusted in relation to the stationary slats, connected to the first support section, can be used, for example, for ensuring that the head can be raised up.

According to a further preferred variant of the invention, a slatted base having two longitudinally running, essentially parallel longitudinal supports, and having a plurality of spaced-apart slats which are arranged transversely to the longitudinal supports and together form a bearing surface for a mattress, is further provided with a supporting-spring arrangement which comprises at least one supporting-spring element which is arranged beneath at least one slat such that it supports the slat, in a central region between the longitudinal supports, by means of spring force. In this case, the supporting-spring element is mounted either on at least one of the two longitudinal supports or on a transverse strut fitted on the two longitudinal supports, and thus supports the slat indirectly at this bearing location. Such a supporting-spring arrangement allows additional resilient or elastic support of the slats in a central zone of the slatted base. It is thus also referred to hereinbelow is hereinbelow [sic] as central-zone reinforcement. Obviously, this aspect of the invention does not absolutely have to be used in conjunction with the use of essentially two-legged leaf-spring elements for connecting the slats to the longitudinal supports.

A supporting-spring arrangement (or a central-zone reinforcement) for a slatted base preferably comprises at least one supporting-spring element which is designed such that it can be arranged beneath at least one slat of the slatted base such that it supports the slat, in a central region between two longitudinal supports of the slatted base, by means of spring force, it being possible for the supporting-spring element to be mounted either on at least one of the two longitudinal supports or on a transverse strut fitted on the two longitudinal supports, and thus for the slat to be supported indirectly at this bearing location. The supporting-spring element may be designed as a leaf-spring element, it being possible for said leaf-spring element to comprise two elongate leaf-spring arms arranged at an angle to one another, with the result that the supporting-spring element is of essentially V-shaped design. Such a V-shaped leaf-spring element may be arranged on the slatted base such that it is mounted on a transverse strut of the slatted base in the region of the connecting angle between the two spring arms and supports the slat from beneath in the region of the longitudinal end [sic] of the arms, said ends being remote from the connecting angle. However, supporting-spring elements which are differently designed and/or are arranged differently on the slatted base are also possible in principle. A central-zone reinforcement may also comprise, for example, a helical spring which is mounted on a transverse strut of the slatted base and supports a slat from beneath.

A supporting-spring arrangement (or a central-zone reinforcement) for a slatted base preferably further comprises means for optionally adjusting the spring force of the supporting-spring element. In the case of a supporting-spring arrangement with a V-shaped supporting-spring element, said spring-adjusting means may comprise, for example, an adjusting screw by means of which the angle between the two spring arms can be adjusted in order to prestress said spring arms and thus to adjust the slat-supporting spring force of the supporting-spring element. However, other suitable means for adjusting the spring force may also be provided in principle. It is thus also possible, for example, to use a device for adjusting the bearing location of the supporting-spring element on the transverse strut or on the longitudinal supports of the slatted base in order optionally to change the prestressing of the supporting-spring element.

Further advantageous embodiments and combinations of features of the invention can be gathered from the following detailed description and from the patent claims taken as a whole.

BRIEF DESCRIPTION OF THE DRAWINGS

In the drawings used for explaining exemplary embodiments.

The same parts are basically provided with the same designations in the figures.

METHODS OF IMPLEMENTING THE INVENTION

Figure 1:
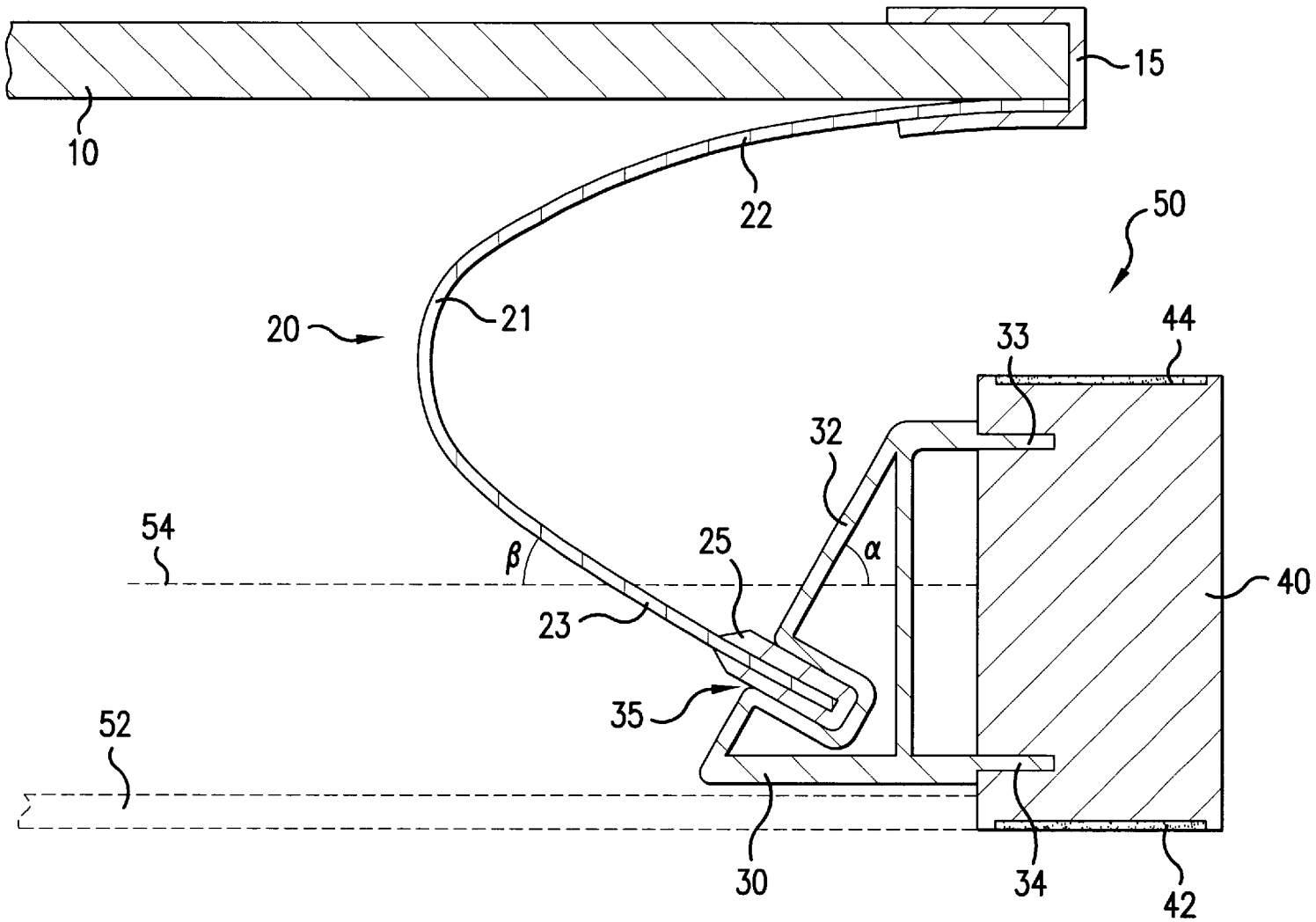
FIG. 1 shows a simplified cross-sectional view of part of a slatted base according to a first preferred manner of implementing the invention.
Figure 2:
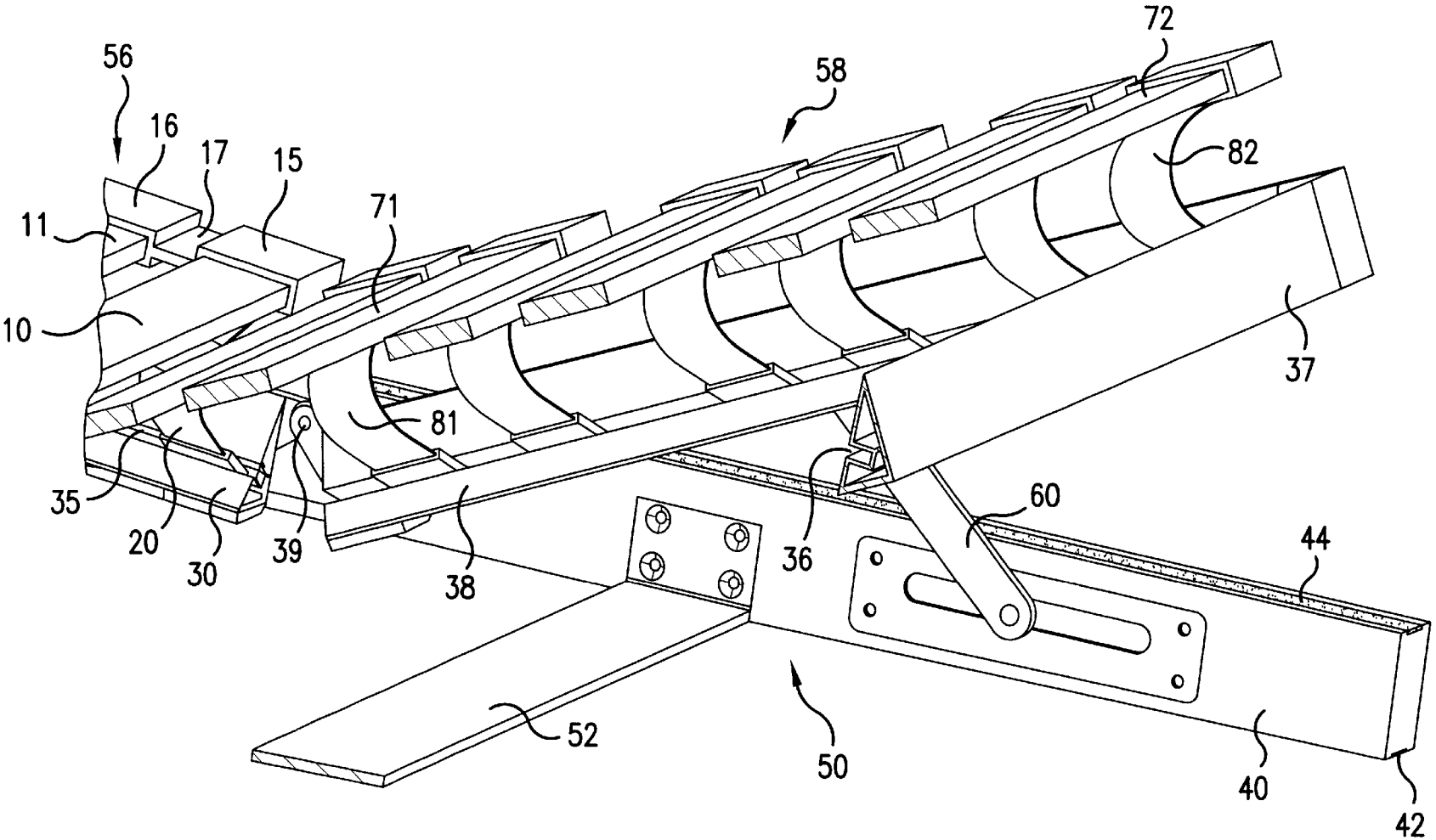
FIG. 2 shows a simplified perspective view, sectioned in a longitudinal direction, of part of the slatted base from FIG. 1.

The slatted base for furniture for lying on which is illustrated in FIGS. 1 and 2 comprises two essentially parallel longitudinal supports 50, of which just one is illustrated in the partial views of FIGS. 1 and 2. The two supports 50 are connected by means of a plurality of transverse struts 52 (of which just one is illustrated, by way of example, in the figures) to form a frame which bears a plurality of spaced-apart slats 10, 11, 71, 72 which are arranged transversely to the longitudinal supports. These slats 10, 11, 71, 72 are connected to the longitudinal supports 50 by means of essentially two-legged leaf-spring elements 20, 81, 82, in each case one leg 22 of a leaf-spring element 20 being fitted on one of the slats 10 and the other leg 23 of said leaf-spring element 20 being fitted on the inner side 32 of one of the longitudinal supports 50. The slats 10, 11, 71, 72 together form a bearing surface for a mattress. As usual, the slatted base illustrated in the figures is arranged such that the bearing surface for the mattress (and thus also the plane 54 defined by the two parallel longitudinal supports as well as the slats 10, 11, 71, 72) are located essentially horizontally.

The longitudinal support 50, which is illustrated in FIGS. 1 and 2, comprises a beam-like spar 40 which is produced from laminated wood and is of a rectangular cross section which is essentially constant over the entire length. The height of the spar is approximately 40 mm. In each case one carbon-fiber-containing strip 44, 42 is fitted on the top side and on the underside of the spar in order to reinforce and/or stiffen the spar 40 structurally.

On the inner side of the spar 40, which is directed toward the other longitudinal support, hollow profiles 30, 38 in the form of extruded aluminum profiles 30, 38 are arranged essentially over the entire length. These extruded aluminum profiles 30, 38, on the one hand, have a load-bearing function and form part of the longitudinal support 50, which essentially comprises the spar 40 and the extruded aluminum profiles 30, 38. The extruded aluminum profiles 30, 38, on the other hand, serve as spring-securing means 30, 38 which are designed such that the leaf-spring elements 20, 81, 82 can be fitted therein.

The longitudinal support 50 has a first longitudinal section 56, in which the spar 40 is fixed essentially over the entire length to a first single-piece hollow profile 30 (an extruded aluminum profile 30 which is designed, at the same time, as a spring-securing means 30) which is fitted on its inner side. FIG. 1 illustrates a cross section through said first longitudinal section 56. As can be seen in FIG. 1, two longitudinally running grooves are formed on the inner side of the spar 40. The first hollow profile 30 is provided with two corresponding combs 33, 34, which are plugged into the grooves, formed on the inner side of the spar, in order to fasten the profile 30 on the spar 40.

The longitudinal support 50 has a second longitudinal section 58. In this second longitudinal section 58, a second single-piece hollow profile 38 (once again an extruded aluminum profile 38 which is designed, at the same time, as a spring-securing means 38) is arranged on the inner side of the spar 40. In contrast to the first hollow profile 30, the second hollow profile 38 in the second longitudinal support section 58, rather than being connected to the spar 40, can be moved in relation to the same. The second hollow profile 38 is articulated on the first hollow profile 30 such that it can be pivoted about an essentially horizontal transverse axis 39. The second longitudinal support (not illustrated) of the slatted base is designed analogously such that the second hollow profiles 38, which are articulated on the support spars 40 such that they can be pivoted about the transverse axis 39, together with the slats 71, 72 fitted on them and/or connected to them form a slatted-base section which can be adjusted in relation to the support spars 40 (and thus in relation to the slats 10, 11, which are connected to the first hollow profiles 30), the two pivotable hollow profiles 38 being connected to one another by means of a hollow profile 37 which connects the hollow profiles transversely to one another and serves as a transverse strut 37. Said transverse strut 37, in the form of a hollow profile, is arranged at the head end of the slatted base. The adjustable slatted-base section is designed for ensuring that the head can be raised up, it being possible for it to be adjusted by means of an adjusting mechanism 60 conventional for slatted bases and to be arrested in the desired position FIG. 1 illustrates in cross section, by way of example, a connecting arrangement for connecting a slat 10 to one longitudinal support 50. Dashed lines likewise illustrate a connecting strut 52 between the two longitudinal supports 50, said connecting strut being located outside the section plane. The first hollow profile 30, which is fixed on the inner side of the support spar 40, has an essentially planar profile wall 32, which is directed toward the other longitudinal support and is referred to hereinbelow as the inner wall 32 of the hollow profile 30. This inner wall 32 of the hollow profile 30, at the same time, forms the inner side 32 of the longitudinal support 50, comprising the spar 40 and the extruded aluminum profile 30. The inner wall 32 of the hollow profile 30 (or the inner side 32 of the longitudinal support 50) is inclined outward in the upward direction in relation to the horizontal 54 (i.e. in relation to the plane 54 which is defined by the two longitudinal supports 50 and is illustrated by a dashed line in FIG. 1), the angle $\alpha$ enclosed between the horizontal 54 and the wall 32 on the inner side of the profile being approximately 60 degrees.

Formed in the wall 32 on the inner side of the hollow profile 30 is a groove 35 which runs in a longitudinal direction of the profile and is intended for accommodating the spring legs 23 of the leaf-spring elements 20, the groove cross section running essentially at right angles to the surface of the inner profile wall 32.

The leaf-spring element 20, which is illustrated in the cross-sectional illustration of FIG. 1, has an essentially U-shaped configuration with two leg sections 22, 23 and a web section 21 connecting these two leg sections 22, 23. The leaf-spring element 20 is produced from glass-fiber-reinforced plastic, the glass fibers being arranged such that they run at least partially in a unidirectional manner in the longitudinal direction of the leaf-spring element 20.

The leaf-spring element 20 is arranged on the slatted base such that the web section 21 is located in the interior of the slatted base, i.e. between the two parallel longitudinal supports 50. The leg section 23, which is fitted on the longitudinal support 50, extends obliquely outward in the downward direction from the web section 21, the end of said spring leg 23 being accommodated in the groove 35, formed in the inner profile wall 32, such that, in relation to the horizontal 54, the angle of inclination $\beta$ of said spring leg 23 is approximately 30 degrees in the region in which it is fitted on the inner profile wall 32. In the manner of implementing the invention which is illustrated in FIGS. 1 and 2, said spring-leg end is provided with a thickened portion 25 made of an elastic material, in order to allow the spring-leg end to be plugged into the groove 35 in a snugly fitting manner.

However, other variants for fitting the spring elements on the longitudinal support are also possible. It is thus possible, for example, for the spring-leg end to be bent through approximately 180 degrees in its end region in order that the curved-over end forms a restraining spring which can be latched into a groove provided with a protrusion on its border, such that the restraining spring latched in behind the protrusion prevents the spring leg from being drawn out of the groove.

The leg section 22, which is fitted on the slat 10, extends obliquely outward in the upward direction from the web section 21. The end of this spring leg 22 runs essentially horizontally in the region of the longitudinal end of the slat 10 and butts against the underside of the slat, the slat 10 and the slat-side spring-leg end being held together by a plastic cap 15. For the assembly of the slatted base, this spring-leg end 22 can simply be plugged in between the underside of the slat and the plastic cap 15, whereupon it is clamped firmly between the slat 10 and the plastic cap 15. If the slat 10 is pressed downward, and the leaf-spring element 20 is bent, by the slatted base being subjected to loading, then the slat-side spring leg 22 rolls on the underside of the slat 10 without producing any aggravating noise.

In the case of the slatted base illustrated in FIGS. 1 and 2, pairs of two adjacent slats 10, 11 of the slatted base are coupled to one another in each case. The plastic cap 15, by means of which the slat 10 is connected in the region of one of its longitudinal ends, on one side of the slatted base, to the leaf-spring element 20, is connected, via a connecting web 17, to the plastic cap 16 of an adjacent slat 11 on the same side of the slatted base. Analogously, the plastic caps of the slats 10, 11 are also connected to one another, in the region of their longitudinal ends, on the other side of the slatted base. The connecting web 17 is produced from an elastic material. In the exemplary embodiment of the invention which is illustrated in FIGS. 1 and 2, the two adjacent plastic caps 15, 16 and the connecting web 17 which connects them are formed as a single-piece plastic part from an elastic polymer material. Connecting pairs of adjacent slats 10, 11 of the slatted base in an elastic manner achieves a coupling between the individual slats of the slatted base which is advantageous for furniture for lying on.

However, other variants for fitting the spring elements on the slats are also possible. It is thus possible, for example, for the slat-side spring-leg end to be angled and to enclose the slat end wholly or at least partially, in order to connect the slat to the leaf-spring element.

The hollow profile 37, which is arranged at the head end of the slatted base and by means of which the two hollow profiles 38, which are articulated on the support spars 40, are connected to one another in the manner of a transverse strut 37, is likewise an extruded aluminum profile and is of essentially the same profile cross section as the two hollow profiles 38, which are articulated on the support spars 40. Formed, once again, in that profile wall of said hollow-profile-like transverse strut 37 which is on the inside in relation to the slatted base is a groove 36 which runs in the longitudinal direction of the profile. A handle (not illustrated) for drawing the adjustable slatted-base section upward can be fitted in said groove 36 at the head end of the slatted base in the same manner as the leaf-spring element 20 is fitted in the groove 35, which is formed in the inner wall 32 of the hollow profile 30, which is fitted on the spar 40 of the longitudinal support 50.

Figure 3:
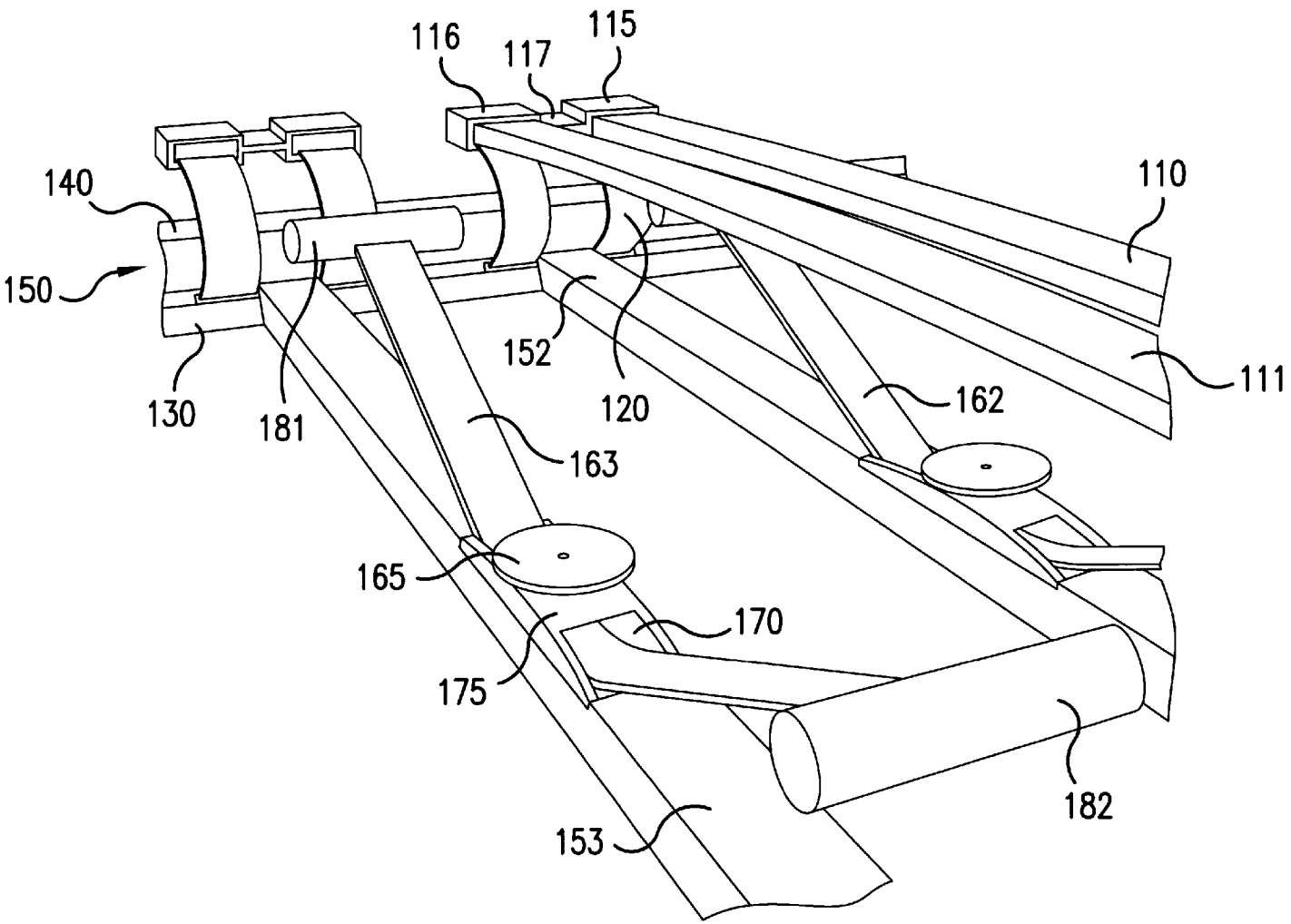
FIG. 3 shows a simplified perspective view of part of a slatted base according to a further preferred manner of implementing the invention.
Figure 4:
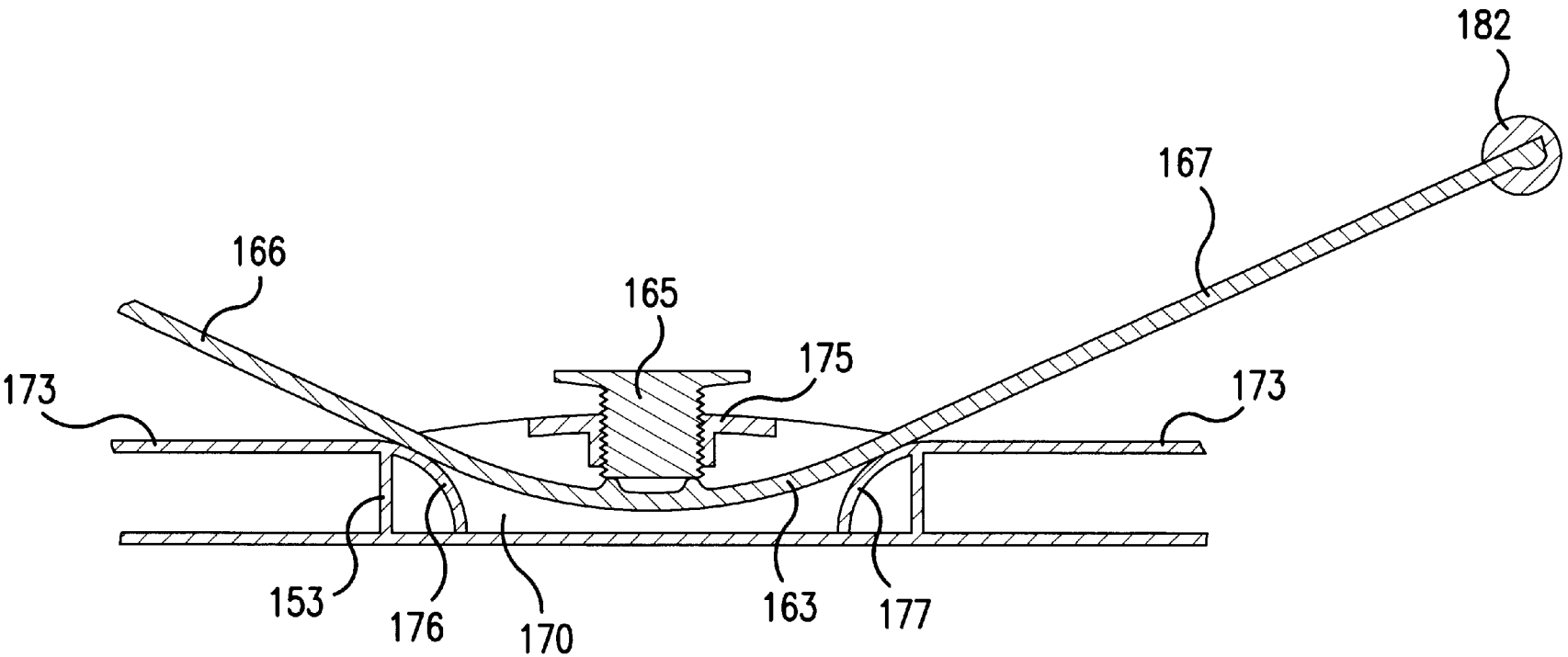
FIG. 4 shows a simplified cross-sectional view of part of the slatted base from FIG. 3.
Figure 5:
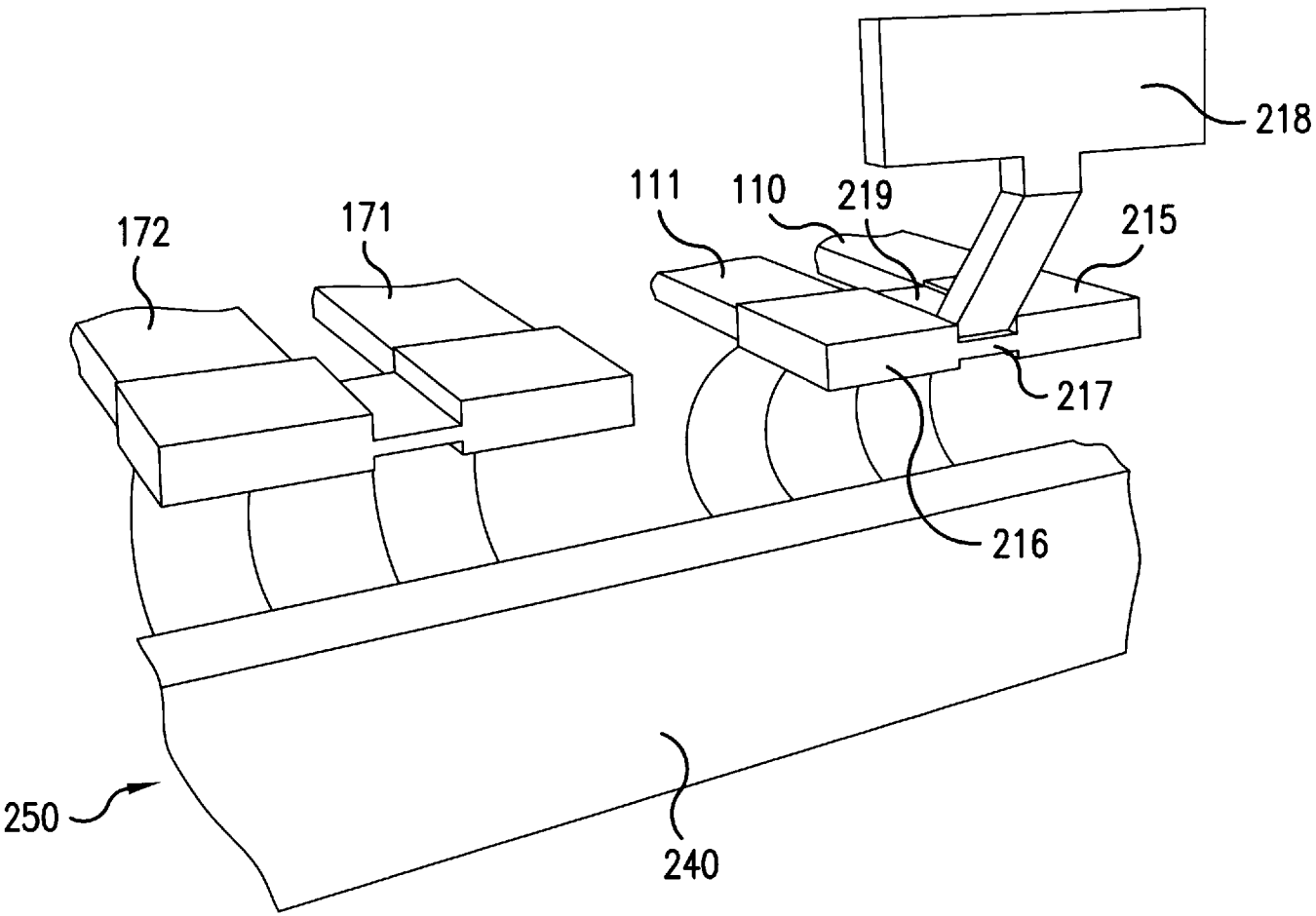
FIG. 5 shows a further simplified perspective view of part of the slatted base from FIG. 3.

FIGS. 3 to 5 illustrate a slatted base according to a further preferred manner of implementing the invention. Two mutually parallel supports 150, 250 are connected to one another by means of transverse struts 152, 153 to form a frame which bears a plurality of spaced-apart slats 110, 111, 171, 172 which are arranged transversely to the longitudinal supports 150, 250. The longitudinal supports 150, 250, once again, each comprise a spar 140, 240 produced from laminated wood, extruded aluminum profiles 130 being fitted on the inner sides of said spars 140, 240 and serving, on the one hand, as securing means for the leaf-spring elements 120, which bear the slats 110, 111, 171, 172, and, on the other hand, for reinforcing the spars 140, 240. In contrast to the slatted base illustrated in FIGS. 1 and 2, the spars 140, 240 of the slatted base illustrated in FIGS. 3 to 5 are not provided with carbon-fiber-containing reinforcing strips. Instead, the spars 140, 240 illustrated in FIGS. 3 to 5 are of greater dimensions than the spars 40 illustrated in FIGS. 1 and 2. In the exemplary embodiment illustrated in FIGS. 3 to 5, the spars 140, 240 are each of rectangular cross section with a height of 50 mm and a width of 25 mm. Otherwise, the extruded aluminum profiles 130, the slats 110, 111, 171, 172, the leaf-spring elements 120, the plastic caps 115, 116, 215, 216 and the connecting webs 117, 217 of the slatted base illustrated in FIGS. 3 to 5 are designed, and arranged on the slatted base, in the same way as the corresponding components of the slatted base illustrated in FIGS. 1 and 2.

FIG. 5, furthermore, illustrates a mattress holder 218, which serves for laterally securing a mattress (not illustrated) resting on the slatted base. The mattress holder 218 has a foot part 219 provided with a horizontal transverse slot. The foot part 219 and the transverse slot formed therein are dimensioned such that the foot part 219 together with the mattress holder 218 can be pushed from the inside of the slatted base onto the connecting web 217 between the plastic caps 215, 216, which are connected to one another by said connecting web 217, until it is positioned against the connecting web 217 by way of its inner slot end and is then secured with clamping action on the connecting web 217. This design means that the mattress holder 218 may optionally be fitted on the slatted base and removed again. In the fitted state, it moves along with the slats 110, 111, which are fitted compliantly on the slatted-base frame by means of the leaf-spring elements 120, and reliably prevents the mattress from being displaced laterally beyond the side border of the slatted base.

The slatted base illustrated in FIGS. 3 to 5 is further provided with an arrangement for adjusting the elasticity of the slatted base if (or the resilient supporting force of the slatted base) in a central region of the slatted base. This supporting-spring arrangement, also referred to as central-zone reinforcement, is illustrated in a simplified perspective partial view in FIG. 3 and in cross section in FIG. 4.

The central-zone reinforcement comprises a plurality of two-armed elongate leaf-spring elements 162, 163, referred to hereinbelow as supporting springs 162, 163, which extend essentially transversely to the longitudinal direction of the slatted base, said longitudinal direction being defined by the longitudinal supports 150, 250, and are each mounted on a transverse strut 152, 153 of the slatted base. In each case one transverse strut 152, 153 together with the supporting spring 162, 163 borne by it is arranged centrally beneath a pair of adjacent slats 110, 111, which are coupled to one another by means of the plastic caps 115, 116, 215, 216, which are connected to one another by the connecting webs 117, 217. For the sake of clarity, the illustration of FIG. 3 has omitted the slats 171, 172 over one of the supporting springs 163 illustrated and has depicted the slats 110, 111 over the other supporting springs 162 illustrated.

In the exemplary embodiment of the invention which is illustrated in FIGS. 3 to 5, the supporting springs 162, 163 are produced from the same material as the spring elements 120 which connect the slats 110, 111, 171, 172 to longitudinal supports, namely from glass-fiber-reinforced plastic, the glass fibers being arranged such that they run at least partially in a unidirectional manner, preferably even wholly in a unidirectional manner, in a longitudinal direction of the supporting springs 162, 163. As an alternative, however, it is also possible for the supporting springs to be produced from spring sheet steel or from other materials which are suitable for leaf springs.

The elongate transverse strut 153 illustrated in cross section in FIG. 4 is designed as a hollow aluminum profile 153. An elongate recess 170 is formed in the top wall 173 of said hollow profile 153, approximately in the longitudinal center. In the region of the two longitudinal borders of said recess 170, the top wall 173 of the hollow aluminum profile 153 is routed downward, in the form of an arc of a circle, onto the base wall of the hollow aluminum profile 153 and defines there two supporting surfaces 176, 177 which are curved upward toward the recess 170. In each case one arm 166, 167 of the supporting spring 163 is mounted on said two supporting surfaces and is supported on the hollow aluminum profile 153 by the supporting surface 176, 177.

Arranged centrally above the recess 170, formed in the top wall 173 of the hollow aluminum profile 153, is a cover part 175, which is fixed to the two side walls of the hollow aluminum profile 153. Formed in said cover part 175 is a vertical bore which is provided with an internal thread. Accommodated in the bore is an adjusting screw 165, which is provided with an external thread corresponding to the internal thread of the bore.

The essentially V-shaped supporting spring 163 rests, by way of its two connecting arms 166, 167, on one of the supporting surfaces 176, 177 in each case such that the two arms 166, 167 of the supporting spring 163 each extend, from the supporting surfaces 176, 177 defining the longitudinal borders of the recess 170, upward and outward in the direction of the side borders of the slatted base. In each case one elongate supporting element 181, 182 is fitted at the outer ends of the arms 166, 167. The supporting elements 181, 182 are arranged on the arms 166, 167 of the supporting spring 163 such that they extend essentially parallel to the longitudinal direction of the slatted base (i.e. transversely to the slats 110, 111, 171, 172) and support from beneath the two slats 171, 172 of the pair of slats arranged above the supporting spring 163, the supporting elements 181, 182 being designed such that the slats 171, 172 can easily slide on them.

The connecting section between the two arms 166, 167 of the supporting spring 163 is routed through beneath the cover part 175 and the adjusting screw 165, the curvature of said connecting section being dimensioned such that the supporting spring 163 between the two supporting surfaces 176, 177, although routed through beneath the adjusting screw 165, does not extend down as far as the base of the hollow aluminum profile 153. By means of the adjusting screw 165, then, it is possible for the connecting section of the supporting spring 163 to be optionally subjected to loading from above and pressed downward or relieved of loading again in relation to the aluminum profile 153, on which the supporting spring 163 is mounted. If the adjusting screw 165 is screwed downward and the connecting section of the supporting spring 163 is thus pressed downward, toward the base of the aluminum profile 153, there is a reduction in the radius of curvature of the connecting section between the two arms 166, 167 of the supporting spring 163. The outer ends of the two arms 166, 167 of the supporting spring 163 are consequently raised and/or pressed upward to a pronounced extent, with the result that the supporting elements 181, 182, which are fitted at said outer ends, subject the slats 171, 172 arranged above them to a greater supporting force. Conversely, the supporting force to which the slats 171, 172 are subjected by the supporting elements 181, 182 is reduced when the adjusting screw 165 is screwed upward and there is thus an increase in the radius of curvature of the connecting section between the two arms 166, 167 of the supporting spring 163. This ensures stepless regulation of the elastic spring force of the slatted base by means of the central-zone reinforcement in a central zone of the slatted base.

In summary, it may be stated that the invention provides a slatted base for furniture for lying on which, on the one hand, is of a low overall height and is thus suitable for positioning in a framework of a piece of furniture for lying on and which, on the other hand, provides a high level of resilient deflection for the slats, in particular also in the region of the slat-bearing longitudinal supports.

| List of designations | |
|---|---|
| 10, 11, 71, 72, 110, 111, 171, 172 | Slat |
| 15, 16, 115, 116, 215, 216 | Plastic cap |
| 17, 117, 217 | Connecting web |
| 20, 81, 82 | Leaf-spring element |
| 21 | Web section |
| 22, 23 | Leg section, spring leg |
| 25 | Thickened portion of the spring-leg end |
| 30, 38, 130 | Hollow profile |
| 32 | Inner side of the hollow profile and/or of the support |
| 33, 34 | Comb |
| 35, 36 | Groove |
| 37 | Transverse strut in the form of a hollow profile |
| 39 | Articulation axis |
| 40, 140, 240 | Spar |
| 42, 44 | Carbon-fiber strip |
| 50, 150, 250 | Longitudinal support |
| 52, 152, 153 | Transverse strut |
| 54 | Horizontal plane |
| 56, 58 | Longitudinal support section |
| 60 | Adjusting mechanism |
| 162, 163 | Supporting spring |
| 165 | Adjusting screw |
| 166, 167 | Spring arm |
| 170 | Recess |
| 173 | Top wall |
| 175 | Cover part |
| 176, 177 | Supporting surface |
| 181, 182 | Supporting element |
| 218 | Mattress holder |
| 219 | Foot part of the mattress holder |

What is claimed is:

1. Slatted base for furniture for lying on, comprising:

two longitudinally running, essentially parallel longitudinal supports with mutually facing inner sides, a plurality of spaced-apart slats which are arranged transversely to the longitudinal supports and together form a bearing surface for a mattress, two-legged leaf-spring elements having first and second legs for connecting the slats to the longitudinal supports, wherein said first leg of each leaf-spring element is fitted on one of the slats and said second leg of said leaf spring element is fitted on the inner side of one of the longitudinal supports, wherein said first leg of the leaf-spring element runs essentially horizontally to the slat and butts against an underside of the slat, the slat and the slat-side spring-leg being held together so that if the slat is pressed downward, and the leaf-spring element is bent, by the slatted base being subjected to loading, then the slat-side spring leg rolls on the underside of the slat.

2. Slatted base according to claim 1, wherein at least one of the leaf-spring elements is arranged such that its second spring leg, extends, from the region in which it is fitted on the longitudinal support, in a direction which, in relation to a plane defined by the two longitudinal supports, is inclined toward the slat which is connected to the leaf-spring element.

3. Slatted base according to claim 2, wherein, in a region where the spring leg is fitted on the longitudinal support, an angle of inclination (β) between the second spring leg and a plane defined by the two longitudinal supports is 5–80 degrees.

4. Slatted base according to claim 3, wherein said angle of inclination (β) between the second spring leg and a plane by the two longitudinal supports is 20–45 degrees.

5. Slatted base according to claim 4, wherein said angle of inclination (β) between the second spring leg and a plane by the two longitudinal supports is substantially 30 degrees.

6. Slatted base according to claim 1, wherein at least one of the leaf-spring elements has an essentially U-shaped configuration with two leg sections and a web section connecting these two leg sections, it being the case that, in the state in which it has been fitted on the slatted base, the web section is arranged in an interior region between the two longitudinal supports such that the two leg sections extend outward, from the web section, toward locations at which they are respectively fitted on the slat and on the inner side of the longitudinal support.

7. Slatted base according to claim 1, wherein at least one of the leaf-spring elements is produced from glass-fiber-reinforced plastic, the glass fibers being arranged such that they run at least partially in a undirectional manner, in the longitudinal direction of the leaf-spring element.

8. Slatted base according to claim 1, wherein the inner side of at least one of the longitudinal supports is provided with spring-securing means which are designed such that one or more of the leaf-spring elements can be fitted therein.

9. Slatted base according to claim 8, wherein the spring-securing means, which are arranged on the inner side of one longitudinal support, comprise a first hollow profile, a groove being formed in a profile wall of said profile, said profile wall being directed toward the other longitudinal support, and the groove being suitable for accommodating leg ends of said second legs of the leaf-spring elements which are to be fitted on the spring-securing means.

10. Slatted base according to claim 9, wherein said profile wall of the hollow profile, is essentially planar and, in relation to the plane defined by the two longitudinal supports, encloses an angle (α) which is 10–85 degrees.

11. Slatted base according to claim 9, further comprising a second hollow profile which is arranged at least at the head end or at the foot end of the slatted base, transversely to the longitudinal supports, has the same cross section as said first hollow profile, which is arranged on the longitudinal support, and is provided with a groove which is suitable for accommodating a handle.

12. Slatted base according to claim 7, wherein the glass fibers run wholly in a unidirectional manner.

13. Slatted base according to claim 9, wherein said first hollow profile is an extruded aluminum profile.

14. Slatted base according to claim 10, wherein said angle (α) is 45–70 degrees.

15. Slatted base according to claim 14, wherein said angle (α) is substantially 60 degrees.

16. Slatted base according to claim 1, wherein at least two adjacent slats are connected to one another by a connection in order to provide a coupling between the two slats.

17. Slatted base according to claim 16, further comprising a mattress holder, which can be fitted on the connection.

18. Slatted base according to claim 1, wherein at least one of the longitudinal supports comprises a spar made of laminated wood, the entire longitudinal support and, in particular, the spar being dimensioned such that the support height over the entire length is less than 50 mm.

19. Slatted base according to claim 18, wherein the spar is provided with at least one reinforcing strips which is fitted at least on its top side or on its underside and has carbon fibers running in the longitudinal direction of the spar.

20. Slatted base according to claims 9, 18 or 19, wherein the longitudinal support, comprising a spar made of laminated wood, has a first section, in which the spar is fixed, essentially over the entire length, to a first single-piece hollow profile of the spring-securing means, said hollow profile being fitted on the inner side of the spar, and a second section, in which a second single-piece hollow profile of the spring-securing means is arranged on the inner side of the spar, the second hollow profile being articulated on the first hollow profile such that it can be pivoted about a transverse axis located essentially in the plane defined by the two longitudinal supports, with the result that the slats, which are connected to the second hollow profile, form a slatted-base section which can be adjusted in relation to the slats, which are connected to the first hollow profile.

21. Slatted base according to claim 18, wherein said support height over the entire length is less than 45 mm.

22. Slatted base according to claim 21, wherein said support height over the entire length is less than 40 mm.

23. Slatted base according to claim 1, having two longitudinal running, essentially parallel longitudinal supports, and having a plurality of spaced-apart slats which are arranged transversely to the longitudinal supports and together form a bearing surface for a mattress, further comprising a supporting-spring arrangement which comprises at least one supporting-spring element which is arranged beneath at least one slat such that it supports the slat, in a central region between the longitudinal supports, by means of spring force either on at least one of the two longitudinal supports or on a transverse strut fitted on the two longitudinal supports.

24. Slatted base according to claim 23, having at least one supporting-spring element wherein said spring element is designed such that it can be arranged beneath at least one slat such that it supports the slat, in a central region between the longitudinal supports, by means of spring force either on at least one of the two longitudinal supports or on a transverse strut fitted on the two longitudinal supports.

25. Slatted base according to claim 24, further comprising means for optionally adjusting the spring force of the supporting-spring element.

26. Slatted base for furniture for lying on, comprising:

two longitudinal running, essentially parallel longitudinal supports with mutually facing inner sides;

a plurality of spaced-apart slats which are arranged transversely to the longitudinal supports and together form a bearing surface for a mattress;

two-legged leaf-spring elements having first and second legs for connecting the slats to the longitudinal supports, wherein said first leg of each leaf-spring element is fitted on one of the slats and said second leg of said leaf-spring element is fitted on the inner side of one of the longitudinal supports; and a longitudinally running groove being formed in each of said inner sides of the longitudinal supports for accommodating one leg of the leaf- spring elements.

27. Slatted base according to claim 26, wherein at least one of the leaf-spring elements is arranged such that its second spring leg, extends, from the region in which it is fitted on the longitudinal support, in a direction which, in relation to a plane defined by the two longitudinal supports, is inclined toward the slat which is connected to the leaf-spring element.

28. Slatted base according to claim 27, wherein, in a region where the spring leg is fitted on the longitudinal support, an angle of inclination ($\beta$) between the second spring leg and a plane defined by the two longitudinal supports is 5–80 degrees.

29. Slatted base according to claim 28, wherein said angle of inclination ($\beta$) between the second spring leg and a plane by the two longitudinal supports is 20–45 degrees.

30. Slatted base according to claim 29, wherein said angle of inclination ($\beta$) between the second spring leg and a plane by the two longitudinal supports is substantially 30 degrees.

31. Slatted base according to claim 26, wherein at least one of the leaf-spring elements has an essentially U-shaped configuration with two leg sections and a web section connecting these two leg sections, it being the case that, in the state in which it has been fitted on the slatted base, the web section is arranged in an interior region between the two longitudinal supports such that the two leg sections extend outward, from the web section, toward locations at which they are respectively fitted on the slat and on the inner side of the longitudinal support.

32. Slatted base according to claim 26, wherein at least one of the leaf-spring elements is produced from glass-fiber-reinforced plastic, the glass fibers being arranged such that they run at least partially in a undirectional manner, in the longitudinal direction of the leaf-spring element.

33. Slatted base according to claim 32, wherein the glass fibers run wholly in a unidirectional manner.

34. Slatted base according to claim 26, wherein the inner side of at least one of the longitudinal supports is provided with spring-securing means which are designed such that one or more of the leaf-spring elements can be fitted therein.

35. Slatted base according to claim 34, wherein the spring-securing means, which are arranged on the inner side of one longitudinal support, comprise a first hollow profile, a groove being formed in a profile wall of said first hollow profile, said profile wall being directed toward the other longitudinal support, and the groove being suitable for accommodating leg ends of said second legs of the leaf-spring elements which are to be fitted on the spring-securing means.

36. Slatted base according to claim 35, wherein said profile wall of the hollow profile is essentially planar and, in relation to the plane defined by the two longitudinal supports, encloses an angle ($\alpha$) which is 10–85 degrees.

37. Slatted base according to claim 35, further comprising a second hollow profile which is arranged at least at the head end or at the foot end of the slatted base, transversely to the longitudinal supports, has the same cross section as said first hollow profile, which is arranged on the longitudinal support, and a groove which is suitable for accommodating a handle.

38. Slatted base according to claim 35, wherein said first hollow profile is an extruded aluminum profile.

39. Slatted base according to claim 36, wherein said angle ($\alpha$) is 45–70 degrees.

40. Slatted base according to claim 39, wherein said angle ($\alpha$) is substantially 60 degrees.

41. Slatted base according to claim 26, wherein at least two adjacent slats are connected to one another by a connection in order to provide a coupling between the two slats.

42. Slatted base according to claim 41, further comprising a mattress holder, which can be fitted on the connection.

43. Slatted base according to claim 26, wherein at least one of the longitudinal supports comprises a spar made of laminated wood, the entire longitudinal support and, in particular, the spar being dimensioned such that the support height over the entire length is less than 50 mm.

44. Slatted base according to claim 43, wherein the spar is provided with at least one or more reinforcing strips which is fitted at least on its top side or on its underside and has carbon fibers running in the longitudinal direction of the spar.

45. Slatted base according to claim 35, 43 or 44, wherein the longitudinal support, comprising a spar made of laminated wood, has a first section, in which the spar is fixed, essentially over the entire length, to a first single-piece hollow profile of the spring-securing means, said hollow profile being fitted on the inner side of the spar, and a second section, in which a second single-piece hollow profile of the spring-securing means is arranged on the inner side of the spar, the second hollow profile being articulated on the first hollow profile such that it can be pivoted about a transverse axis located essentially in the plane defined by the two longitudinal supports, with the result that the slats, which are connected to the the second hollow profile, form a slatted-base section which can be adjusted in relation to the slats, which are connected to the first hollow profile.

46. Slatted base according to claim 43, wherein said support height over the entire length is less than 45 mm.

47. Slatted base according to claim 46, wherein said support height over the entire length is less than 40 mm.

48. Slatted base according to claim 26, having two longitudinal running, essentially parallel longitudinal supports, and having a plurality of spaced-apart slats which are arranged transversely to the longitudinal supports and together form a bearing surface for a mattress, further comprising a supporting-spring arrangement which comprises at least one supporting-spring element which is arranged beneath at least one slat such that it supports the slat, in a central region between the longitudinal supports, by means of spring force either on at least one of the two longitudinal supports or on a transverse strut fitted on the two longitudinal supports.

49. Slatted base according to claim 48, having at least one supporting-spring element, wherein said spring element being designed such that it can be arranged beneath at least one slat such that it supports the slat, in a central region between the longitudinal supports, by means of spring force either on at least one of the two longitudinal supports or on a transverse strut fitted on the two longitudinal supports.

50. Slatted base according to claim 49, further comprising means for optionally adjusting the spring force of the supporting-spring element.

* * * * *